United States Patent [19]

Stith

[11] 4,135,333

[45] Jan. 23, 1979

[54] APPARATUS FOR GRINDING A CYLINDRICAL OPTICAL LENS

[76] Inventor: Joe D. Stith, Rte. 4, Box 640, Muskogee, Okla. 74401

[21] Appl. No.: 846,417

[22] Filed: Oct. 28, 1977

[51] Int. Cl.[2] ..... B24B 13/02

[52] U.S. Cl. ..... 51/160; 51/58

[58] Field of Search ..... 51/58, 160

[56] References Cited

U.S. PATENT DOCUMENTS

| | | | |
|---|---|---|---|
| 1,593,212 | 7/1926 | Hart | 51/58 |
| 3,552,899 | 1/1971 | Tagnon | 51/160 |
| 3,782,042 | 1/1974 | Strasbaug | 51/58 |

*Primary Examiner*—Harold D. Whitehead

*Attorney, Agent, or Firm*—Head, Johnson & Chafin

[57] ABSTRACT

An apparatus for grinding cylindrical lenses, comprising a frame supporting a motor-driven apparatus in which a vertical driving pin is adapted to be moved parallel to itself, in complex motion, which is substantially non-repetitive. Three separate drive means are provided for producing eccentric motion of selected amplitude, and individually controllable relative phase angle with each other. The driving pin is connected with a universal joint, to a vertical post which is pivoted at its bottom end, and adapted for angular motion forward and backward and to each side, but does not have any component of rotary motion about its own axis. Arm means are provided attached to the post, for pressing a lens block holding a lens to be ground, against a stationary lap, so as to grind a cylindrical surface on the lens.

6 Claims, 7 Drawing Figures

APPARATUS FOR GRINDING A CYLINDRICAL OPTICAL LENS

BACKGROUND OF THE INVENTION

1. Field of the Invention

This invention lies in the field of the grinding and polishing of lens surfaces, such as for spectacles, in which the lens is held attached to a lens block, and is pressed against a lap of a selected curvature, etc.

Still more particularly, it concerns the apparatus for grinding a cylindrical lens, in which the lens block holding the lens is adapted to have rotation about its longitudinal and/or transverse axes, but no rotation about a vertical axis.

2. Description of the Prior Art

In the prior art there are a number of patents pertaining to the general art of grinding lenses, most of which have spherical surfaces, which require a type of movement of the lens block different from that provided in this apparatus.

In this apparatus the motion of the block is complex, having three degrees of eccentricity of motion, one of which is adjustable. Different relative phase angles, and different angular speeds are provided for the three components of motion, which are not shown in the prior art, and the output motion represented by a motion of an upright drive post, pivoted at its bottom end, is in a side-to-side and fore-and-aft motion but without any rotation about the longitudinal axis of the post. Thus the lens block moves parallel to itself without rotation about a vertical axis, while it is given random angular motions about its longitudinal and transverse horizontal axes.

The prior art fails to show this type of a drive system.

SUMMARY OF THE INVENTION

It is a primary object of this invention to provide a type of lens grinding apparatus in which a lens block can be driven, with a nominal horizontal position, and with rotary motion about its longitudinal and transverse axes. There is no rotation of the lens block about a vertical axis as there would be for a lapping operation for a spherical lens.

The motion of the block has three component eccentricities, one of which is infinitely adjustable within a selected range. The relative speed of rotation of the three eccentricities is fixed. However, the relative phase angle or initial positions of the three eccentricities is adjustable.

The apparatus comprises a frame including a vertical bracket and support walls. A bearing block attached to the vertical bracket is bored with a vertical bracket is bored with a vertical axis first opening, to support a large diameter first stub shaft. There is a second bored opening in the first stub shaft. The axis of the second opening is parallel to, and spaced from the axis of the first opening. A second stub shaft is inserted in the second opening. It has a third opening, the axis of which is offset from and parallel to the axis of the second stub shaft. A third small diameter drive shaft is positioned in bearings in this third opening. There are drive wheels on the tops of each of the stub shafts and on the drive shaft, which are driven at selected same, or different speeds, by three other pulleys through cog belts. All wheels are driven from a motor at separate selected speeds.

The vertical drive shaft has an eccentric hub on its lower end, which supports a vertical drive pin, at a selected spacing from the axis of the drive shaft, which spacing can be adjusted.

There is a vertical post supported in a gimbal at its bottom end. This permits transverse movement of the post, but no rotation about its longitudinal axis. A universal self-aligning bearing in its top is driven by the driving pin.

A horizontal arm is supported on a transverse shaft through the post. The arm at one end supports a drive pin for the lens block, and at the other end is supported by a spring means, so as to maintain a selected force of the lens block onto the lap surface. Various types of circular and elliptical motion having two or three spaced loops, etc. are possible with the apparatus of this invention.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
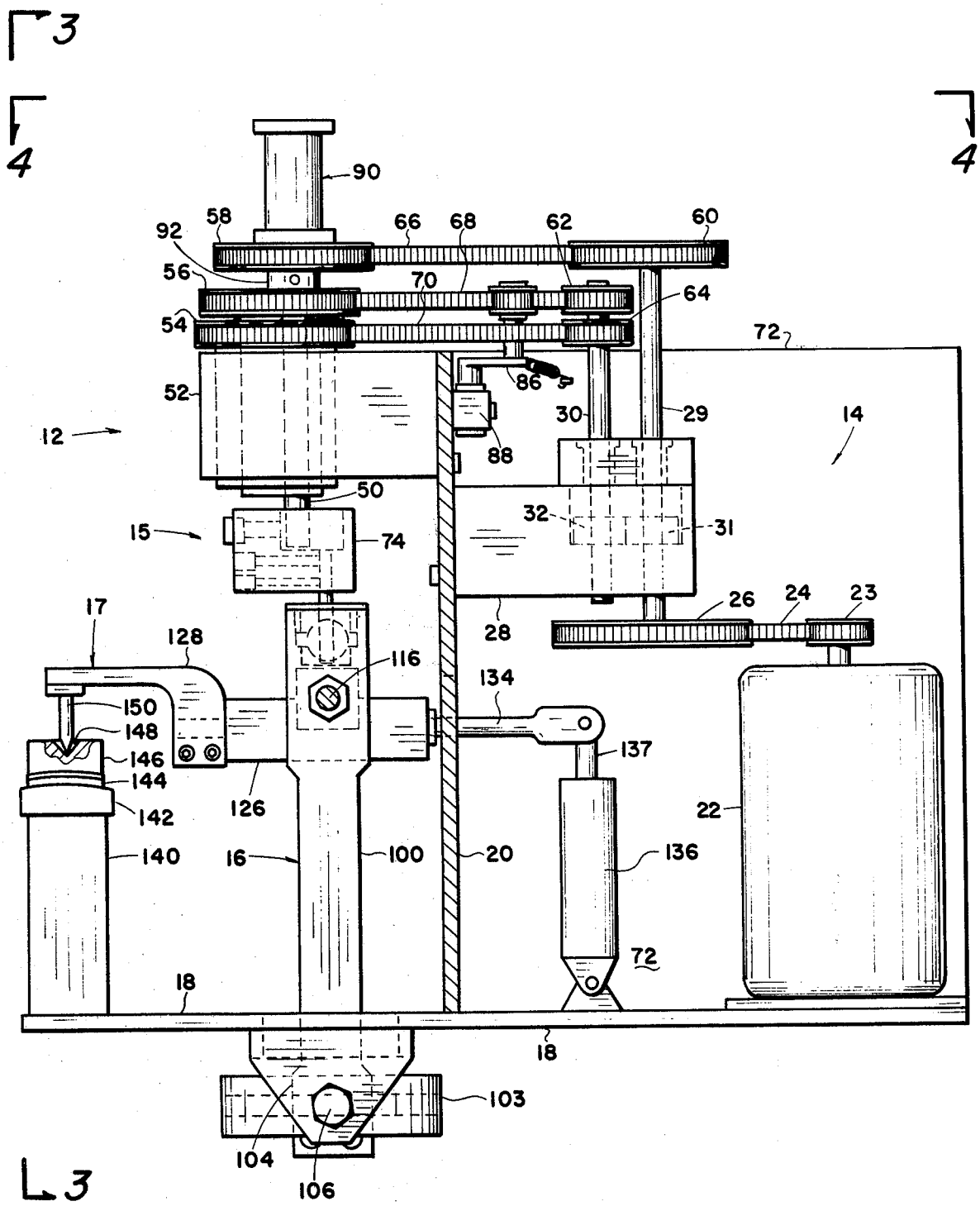
FIG. 1 represents a vertical side elevation view of the apparatus of this invention.
Figure 2:
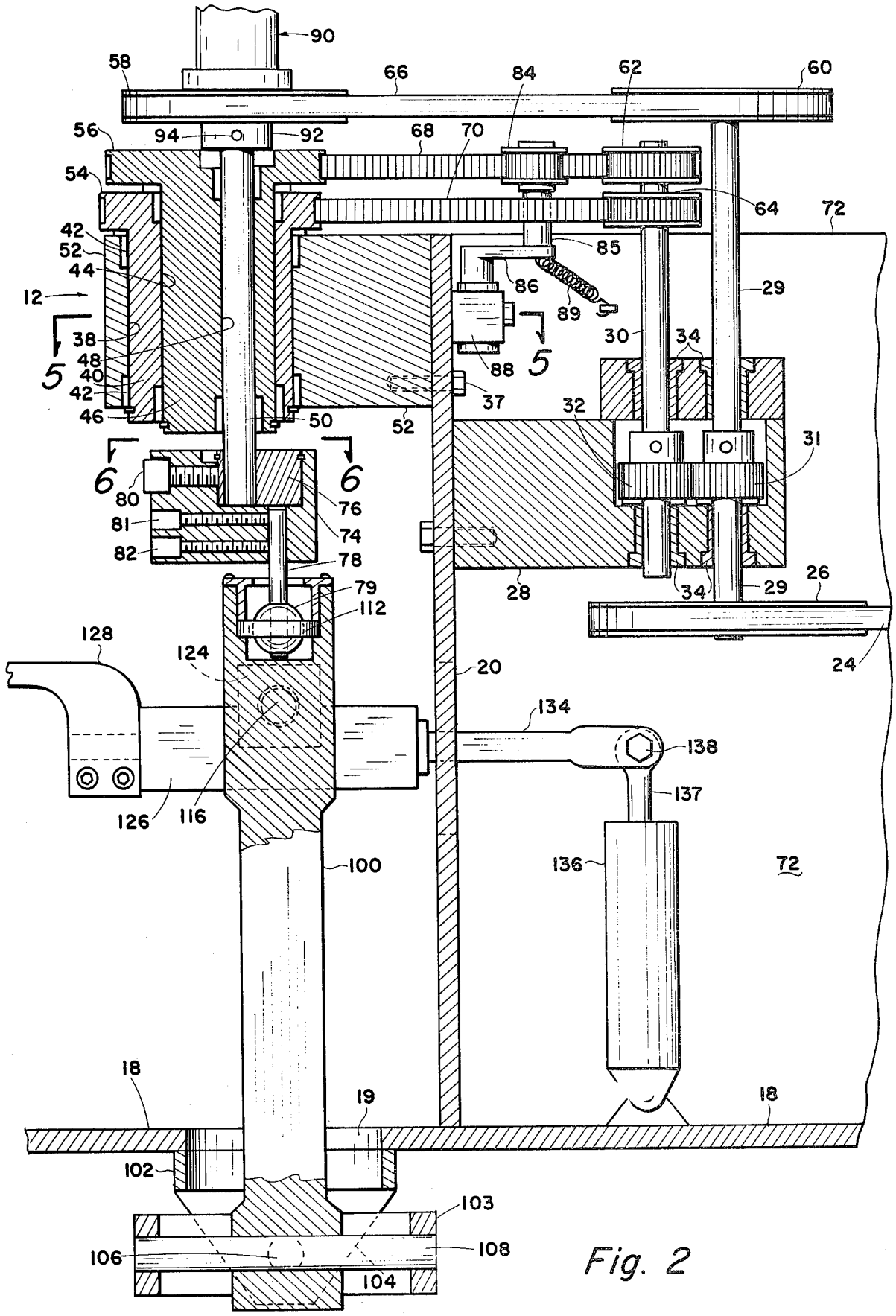
FIG. 2 represents an enlarged cross-sectional view of a portion of FIG. 1.
Figure 3:
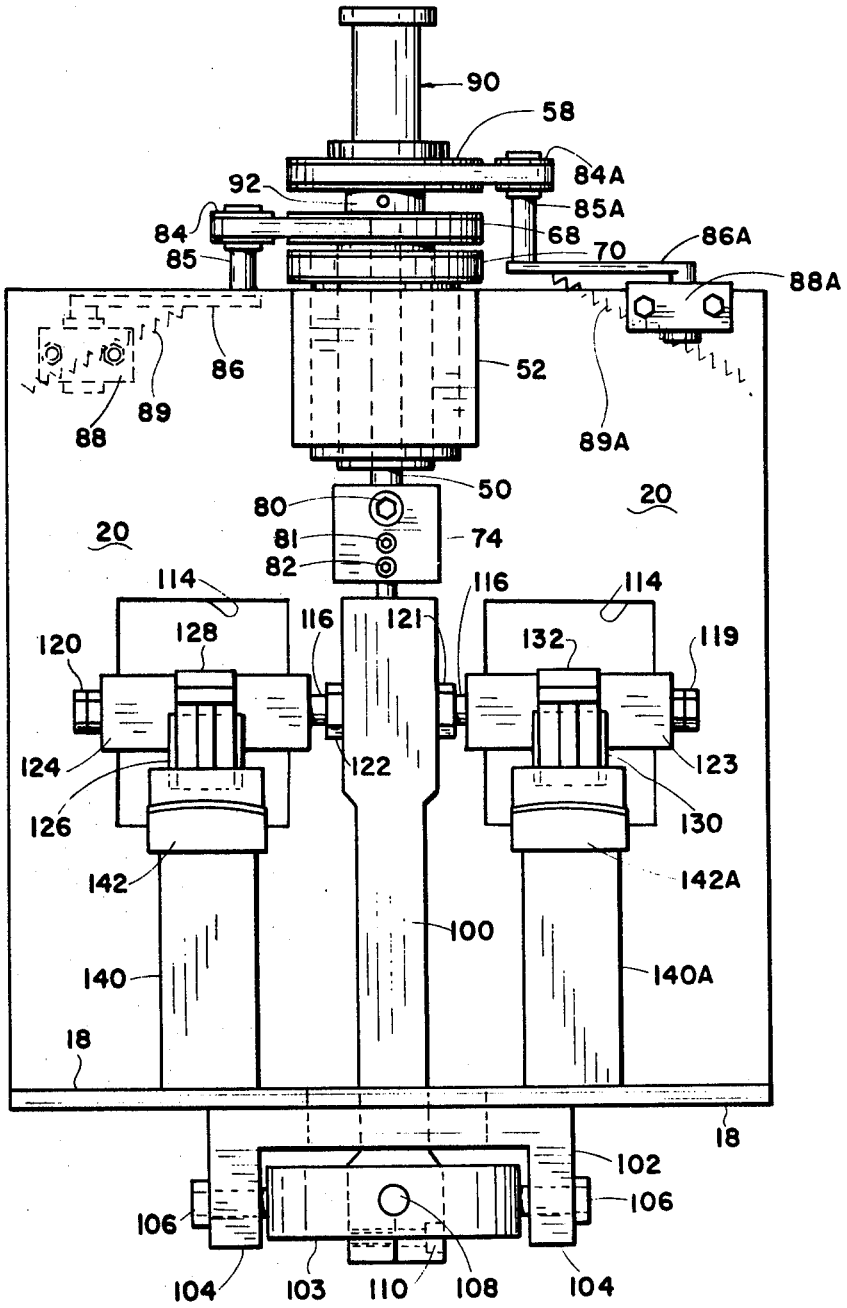
FIG. 3 illustrates a vertical front elevation view of the apparatus.

Referring now to the drawings and in particular to FIGS. 1 and 2, there is shown a side elevation and a cross-section of part of the apparatus.

The apparatus can be broken up in its description into a group of sub-assemblies, such as the following:

1. A frame,
2. the eccentric motion drive apparatus,
3. the motor and drive apparatus,
4. the output driving hub,
5. the vertical post,
6. the second shaft means and the lap, and finally
7. the lap means.

These various sub-assemblies are indicated generally by the numeral 10 which indicates the total apparatus. Numeral 12 indicates the eccentric drive mechanism. Numeral 14 indicates the motor and drive apparatus. Numeral 15 indicates the driving hub, 16 the vertical post, and 17 the arms and lap means.

1. The general configuration of the frame of the apparatus includes a base plate 18 of selected thickness, which may be a plate or a casting, and a vertical wall 20 which is transverse to the base. The vertical wall 20 is supported by side walls 72 and 72A, for example.

2. The eccentric mechanism 12 comprises a bearing block 52 which is supported near the top of the transverse wall or bracket 20, by means of bolts 37, or the equivalent. The bearing block 52 has a first vertical cylindrical opening 38, which includes bearings, such as, for example, 42. The first opening 38 and bearings 42 support a first stub shaft 40, which is journalled in the bearings 42. At the top of the first stub shaft is a cog drive wheel 54 which is driven by a cog belt 70, for example.

The first stub shaft 40 has a second vertical opening 44, the axis of the second opening is parallel to the axis of the first opening, and the axis of the first shaft, but is offset by a selected distance to provide an eccentric motion, as is well known in the art. A second stub shaft 46 is journalled in the second opening 44 in the first stub shaft, and the second stub shaft has a cog wheel 56 at its top end, similar to that on the first stub shaft.

The second stub shaft has a third opening 48, the axis of which is parallel to the axis of the second stub shaft with a selected displacement, or offset. A drive shaft 50 is journalled in the third opening in the second stub shaft, and carries a drive means 58 at the top of the shaft.

3. The drive mechanism indicated by numeral 14 comprises a motor 22 supported on the base 18, or otherwise as is well known in the art. There is a bracket 28 attached to the transverse dividing wall or bracket 20. There are two vertical shafts 29 and 30 which are arranged in suitable bearings 34 in the bracket 28. The two shafts are geared together by gears 31 and 32.

The drive motor has a cog pinion 23 in its shaft which drives a cog wheel 26 on the bottom of the shaft 29 through the means of a cog belt 24, all of which is well known in the art.

The top of the shaft 29 carries a cog wheel 60 which drives a corresponding cog wheel 58 supported on the top of the shaft 50. The cog wheel 58 has a hub 92 which is pinned 94, to the shaft 50.

The first and second stub shafts are driven through their cog wheels 54 and 56 respectively through belts 70 and 68 respectively to the cog pinions 64 and 62 respectively, which are mounted on shaft 30 and driven by gear 32 from gear 31 and the shaft 29. Thus means are provided for the motor to drive one shaft 29, which then provides three different drives to three different shafts, at selected speeds, with selected eccentricities, etc.

4. The lower end of the shaft 50 carries a coupling or hub 74. Inserted into the top of the hub 74 is a cylindrical block 76, which is circular, and is held into an appropriate bored opening in the top of the hub 74. There is an eccentric opening into the block 76 into which the shaft 50 is pressed. A set screw 80 is adapted to hold the block 76 in position.

There is a vertical drive pin 78 of selected length and diameter inserted into the bottom of the hub 74 at a selected radius from the axis of the hub 74. This pin is locked by means of two set screws 81 and 82. It will be clear that by loosening the set screw 80 and rotating the block 76 within the hub 74 that the relative spacing or offset between the axis of the shaft 50 and the drive pin 78 can be altered.

5. There is a substantially vertical post 100, which is supported at its lower end in a gimbal support, 103. This comprises a bracket 102, which is supported to the base 18 around an opening 19. The bracket has two wing portions 104, which by means of stub shafts 106 support a circular ring 103. There is a shaft 108 journalled in the ring 103. The axis of the shaft 108 is at right angles to the axis of the two stub shafts 106. The bottom end of the post 100 is bored out to receive and to clamp around the shaft 108.

It will be clear therefore that by this means the vertical post 100 can be moved forward and backward or to the left or to the right in a conical motion, etc. while there is no rotation whatsoever about the longitudinal axis of the post 100. In other words, if the post is rectangular, then the sides move without rotation about a vertical axis, but when the arm moves forward and backwards, the sides move in a plane. Conversely, when the arm moves from left to right the front and back surfaces of the post will move in their planes, but there is no rotation about the longitudinal axis of the post. This is important since the movement of the lens block and lens must be with the longitudinal axis moving in a plane, for example.

At the upper end of the post 100, there is a bored-out opening into which is set a bearing ring 112 which slides over the surface of a spherical ball 79, so that as the shaft 50 rotates and the drive pin 78 moves in a complicated manner, parallel to itself, the ball will cause the ring 112 and the end of the post 100 to move in a corresponding manner, without rotating about its longitudinal axis. There is a shaft 116 which passes through the post (at right angles to its length) from side to side when viewed in terms of the front and side views of the figures. While the drawing shows shaft 116 extending at a right angle to post 100, the shaft may extend at a selected angle from each side of the post. There are two rectangular blocks 124 and 123, which are journalled on the shaft 116, and are held in position by nuts 119, 120, for example, on the outer ends of the shafts. The rectangular blocks 124 and 123 have cross-arms 126 and 130, respectively, which likewise rotate about the axis 116. On the front end of the arms 126 and 130 there are extensions 128 and 132, which at their outer extremities support drive pins 150 which fit into corresponding conical detents 148 in lines blocks 146, to which are attached lenses 144, which are pressed in contact with suitable laps 142 which can be supported in any conventional manner on posts 140, for example.

It will be clear that for small angular motions of the post 100 that the motion of the drive pins 150 will be identical to each other, both in the fore-and-aft and side-to-side motion and to the drive pin 78. Thus in this means a single post 100 can be used to handle two lapping operations.

The purpose of the shafts 116 is to permit the angle of the arm 126 to change with the rotation, or the tilt of the post 100, and thus to maintain proper pressure contact of the lens against the lap. This pressure contact is maintained by a spring or similar means, such as an air cylinder 136 that provides a selected pressure, or pressure range, between its piston rod 137 to the arm extension 134 of FIG. 1, to tilt the arm 126 so as to maintain the proper pressure at the point of the drive pin 150.

Figure 4:
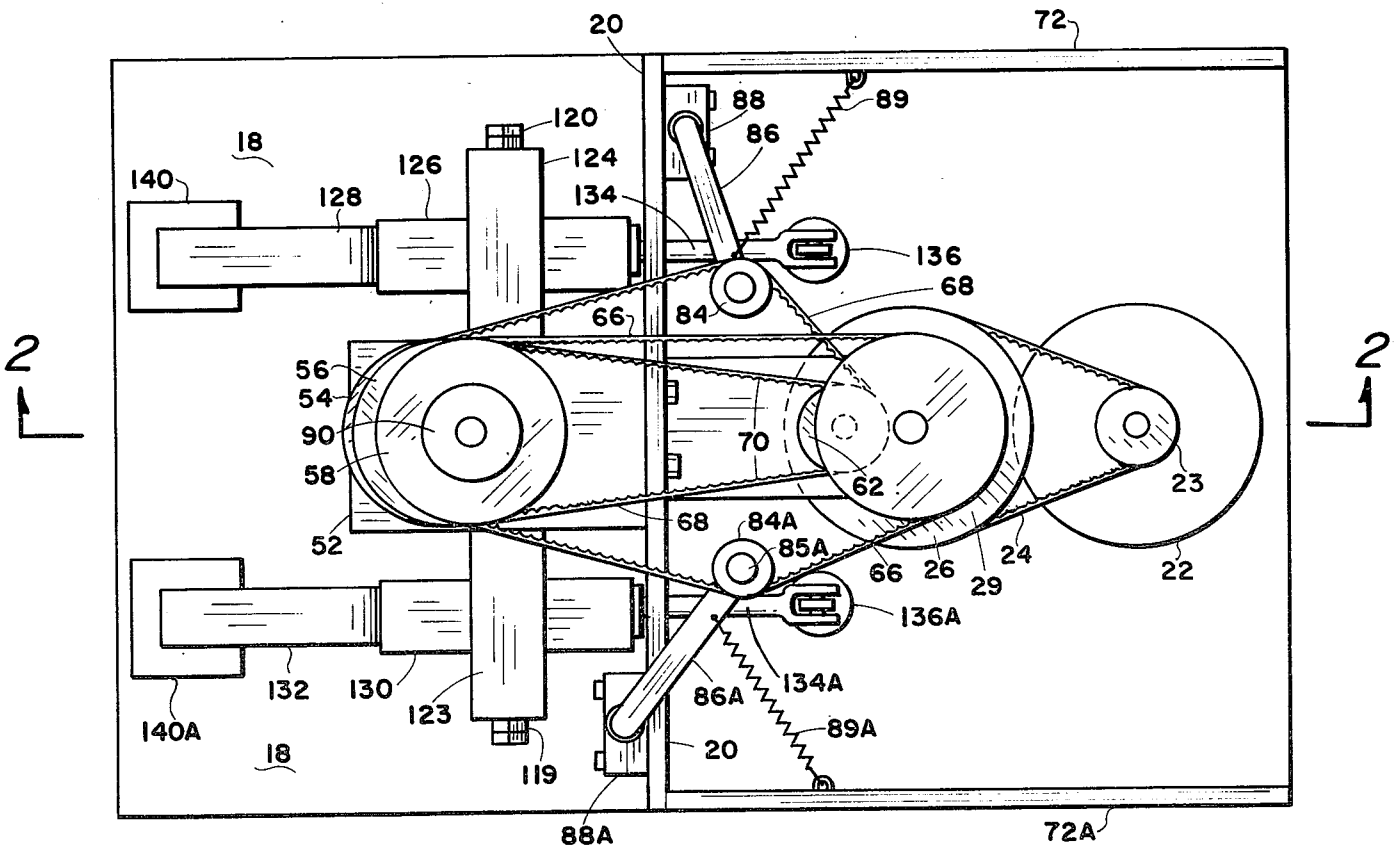
FIG. 4 illustrates a top plan view of the apparatus.

Referring now to FIG. 4, there is shown a top view of the apparatus, and two additional features which are important to the driving. For example, consider the drive cog pinion 64, belt 70, and cog wheel 54. The axes of the shaft 30, and first stub shaft 40, are of fixed spacing, and thus a belt of selected length will properly fit between the two cog wheels 64 and 54. However, the drive belts 66 and 68 tie together cog wheels 60 and 58, for example, by belt 66 and cog wheels 62 and 56, for example, by cog belt 68. The spacing between shaft 30 and the second stub shaft, and the third shaft 50, continually change as the first and second stub shafts rotate and so on. In order to provide for the variable shaft spacing, idler wheels such as 84 and 84A are provided on arms 86 and 86A respectively, which are journalled in blocks 88 and 88A respectively. The arms are restrained by springs 89 and 89A, so as to keep a proper tension in the belts 68 and 66, respectively.

Figure 5:
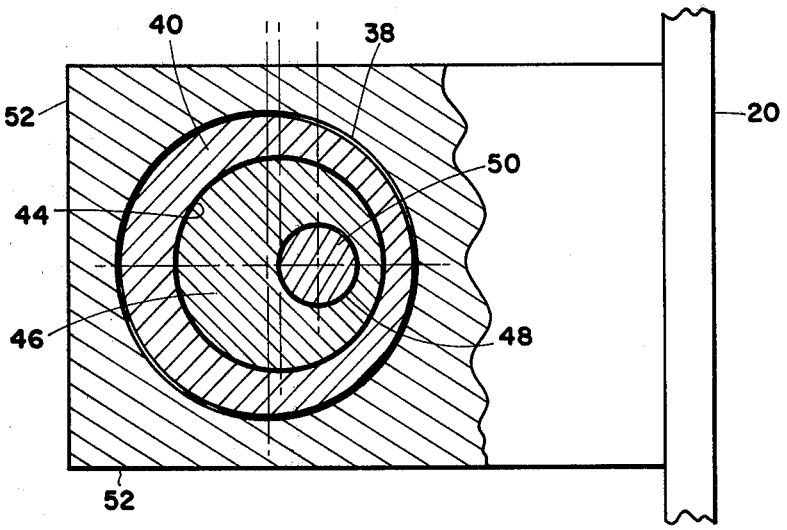
FIG. 5 illustrates a cross-section taken across the plane 5—5 of FIG. 2.

Referring now to FIG. 5, there is a partial cross-section of the bearing block 52 which shows the first opening 38, the first stub shaft 40, the second opening 44, the second stub shaft 46, the third opening 48, and the third shaft 50.

Figure 6:
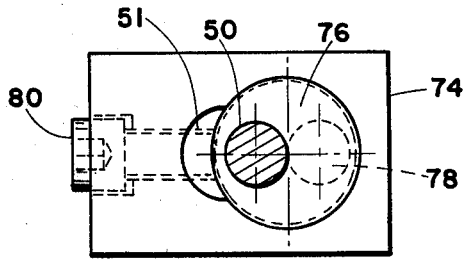
FIG. 6 illustrates a view taken across the plane 6—6 of FIG. 2.

In FIG. 6 there is another view of the hub 74 which is driven by the shaft 50 which is pressed into a cylindrical plug 76 which is held in a cylindrical cavity in the hub 74, and locked there by means such as lock rings, or other means.

The set screw 80 locks the position of the cylindrical hub 76 into the hub 74. There is an opening 51 provided for a retaining ring to hold 74 and 76 together when set screw 80 is loosened to change relationship of 74 to 76. Shown in dashed outline is the drive pin 78 which extends down below the hub 74.

Figure 7:
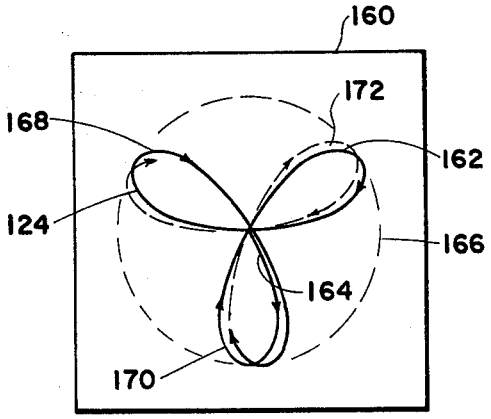
FIG. 7 illustrates one type of motion of the drive pin and of the lens block, relative to the lap.

FIG. 7 illustrates one type of figure of motion that is possible by the drive apparatus of this invention. The figure can be traced by following the arrows. Starting with the arrow 164 the motion progresses radially outwardly to a loop at the limiting radius of the dashed circle 166, and then 170 back towards and through the center following 162 to the outer radius 166 again back through the center to the loop 168 back through the center and then follows at a slight advanced angle, a similar pattern with the loop 170, 172, 174, and so on.

What has been described is a lapping machine which has an operative post which is adapted to be supported at a fixed point at its bottom and to move freely so that the axis can take any angle within a limited range in a lateral direction. The post is held fast against rotation around its own vertical axis. The lateral motion of the top of the post is communicated by two arms to two drive pins which can move correspondingly, two lens blocks against two laps, so that a double grinding operation can be maintained. The limitations against rotation of the post 100 limits the movement of the lens blocks to a cylindrical type of motion whereby the lens block rotates about an axis parallel to its length or perpendicular to its length, but does not rotate about a vertical axis.

A complex motion can be provided by three different eccentricities, which can be driven at three different speeds, with selected angles between them.

In order to change the angle between the first and second stub shafts, the belt tightener arm 86 can be moved inwardly to loosen the belt 68 so that it can be slipped around one of the other of the two drive pulleys and thus change the angle of the second stub shaft and its wheel 56 with respect to the first stub shaft and its wheel 54, for example. While the eccentricities of the first and second stub shafts are fixed, the eccentricity of the drive pin 78 with respect to the shaft 50 can readily be changed within a selected range.

No detail has been provided regarding the lens blocks, lenses, laps, and mounting for the laps, for example, since all of this is well known in the art and is conventional in all respects.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. Apparatus for grinding cylindrical lenses, comprising:
   (a) a frame including at least a base and a vertical bracket;
   (b) a bearing block supported by said frame and having a first vertical opening;
   (c) a first stub shaft journalled in said first opening, a second vertical opening in said first stub shaft, with axis parallel to, but offset a selected distance from the axis of said first stub shaft;
   (d) a second stub shaft journalled in said second opening, a third vertical opening in said second stub shaft, with axis parallel to, but offset a selected distance from the axis of said second stub shaft;
   (e) first vertical drive shaft means extending through and journalled in said third opening;
   (f) motor means and means to drive said first stub shaft, said second stub shaft, and said first vertical drive shaft at selected speeds, in selected directions, respectively;
   (g) a driving hub on the bottom end of said first vertical shaft, including a first driving pin with axis parallel to but offset a selected distance from the axis of said first vertical shaft;
   (h) a vertical post and means to support said post at its bottom end for rotation laterally, but without rotation about the axis of said post, responsive to said first driving pin;
   (i) a second shaft means transverse to said post and at least one substantially horizontal arm journalled on said second shaft means, said at least one arm carrying a second driving pin;
   (j) lap means and means controlled by said second drive pin to press and move a lens block and lens over said lap.

2. The apparatus as in claim 1 including means to change the offset of said first drive pin.

3. The apparatus as in claim 1 including at least two horizontal arms journalled on said second shaft means, one on each side of said post, and including two second drive pins, lap means, and lenses.

4. The apparatus as in claim 1 in which said means to press said lens block and said lens to said lap comprises spring means.

5. The apparatus as in claim 4 in which said spring means comprises air cylinder means.

6. The apparatus as in claim 1 in which said means to support said post at its bottom end comprises gimbal means.

* * * * *